United States Patent [19]

Feinberg

[11] 4,257,221

[45] Mar. 24, 1981

[54] FIRE RESISTANT FIBER BLEND

[76] Inventor: Arthur L. Feinberg, R.F.D. 1, Putnam Valley, N.Y.

[21] Appl. No.: 56,858

[22] Filed: Jul. 12, 1979

Related U.S. Application Data

[63] Continuation-in-part of Ser. No. 853,314, Nov. 21, 1977, abandoned.

[51] Int. Cl.[3] ..... D02G 3/04; D02G 3/44; D01G 9/08

[52] U.S. Cl. ..... 57/256; 57/255; 57/327; 57/904; 19/145.7

[58] Field of Search ..... 57/252, 255, 256, 904; 19/145, 145.5, 145.7, 243; 264/185

[56] References Cited

U.S. PATENT DOCUMENTS

| | | | |
|---|---|---|---|
| B 378,760 | 3/1976 | Economy et al. . | |
| 1,722,006 | 7/1929 | Nigrin et al. | 19/243 |
| 2,025,394 | 12/1935 | Langen | 19/252 |
| 3,017,292 | 1/1962 | Masher | 428/921 X |
| 3,027,222 | 5/1962 | Wilkinson | 428/921 X |
| 3,067,471 | 12/1962 | Noda | 19/243 |
| 3,176,351 | 4/1965 | Keen | 19/243 X |
| 3,188,790 | 6/1965 | Hebeler | 57/256 X |
| 3,216,064 | 11/1965 | Kates | 19/243 |
| 3,344,479 | 10/1967 | Bryan | 19/236 X |
| 3,421,186 | 1/1969 | Halleux et al. | 19/243 |
| 3,741,855 | 6/1973 | Harrison et al. | 428/259 X |
| 3,749,599 | 7/1973 | Bergman | 428/921 X |
| 3,763,644 | 10/1973 | Jackson et al. | 57/255 X |
| 3,852,947 | 12/1974 | Mayer | 57/904 X |
| 3,864,156 | 2/1975 | Weil | 428/921 X |
| 3,866,405 | 2/1975 | Knopka | 57/255 |
| 3,871,946 | 3/1975 | Romanski et al. | 428/259 X |
| 3,887,676 | 6/1975 | Okamura et al. | 264/185 X |
| 3,925,290 | 12/1975 | Matsuo et al. | 264/185 X |
| 4,001,477 | 1/1977 | Economy et al. | 57/255 X |
| 4,004,405 | 1/1977 | Darchuk | 57/904 X |
| 4,015,038 | 3/1977 | Romanski et al. | 428/259 X |

FOREIGN PATENT DOCUMENTS

| | | | |
|---|---|---|---|
| 1134187 | 11/1968 | United Kingdom | 19/145.7 |

*Primary Examiner*—Donald Watkins
*Attorney, Agent, or Firm*—Amster, Rothstein & Engelberg

[57] ABSTRACT

A method for producing chemically untreated fire resistant fiber blends includes the steps of separately blowing and carding bundles of selected matrix and staple fibers, respectively, to form separate slivers of each of the two fibers. Given proportions of each fiber are then combined during a common drawing step to form a bulky blended sliver which is then conventionally processed to produce a fire resistant yarn. The yarn is suitable for knitting or weaving to provide fabrics which far exceed current government fire resistant standards.

8 Claims, 1 Drawing Figure

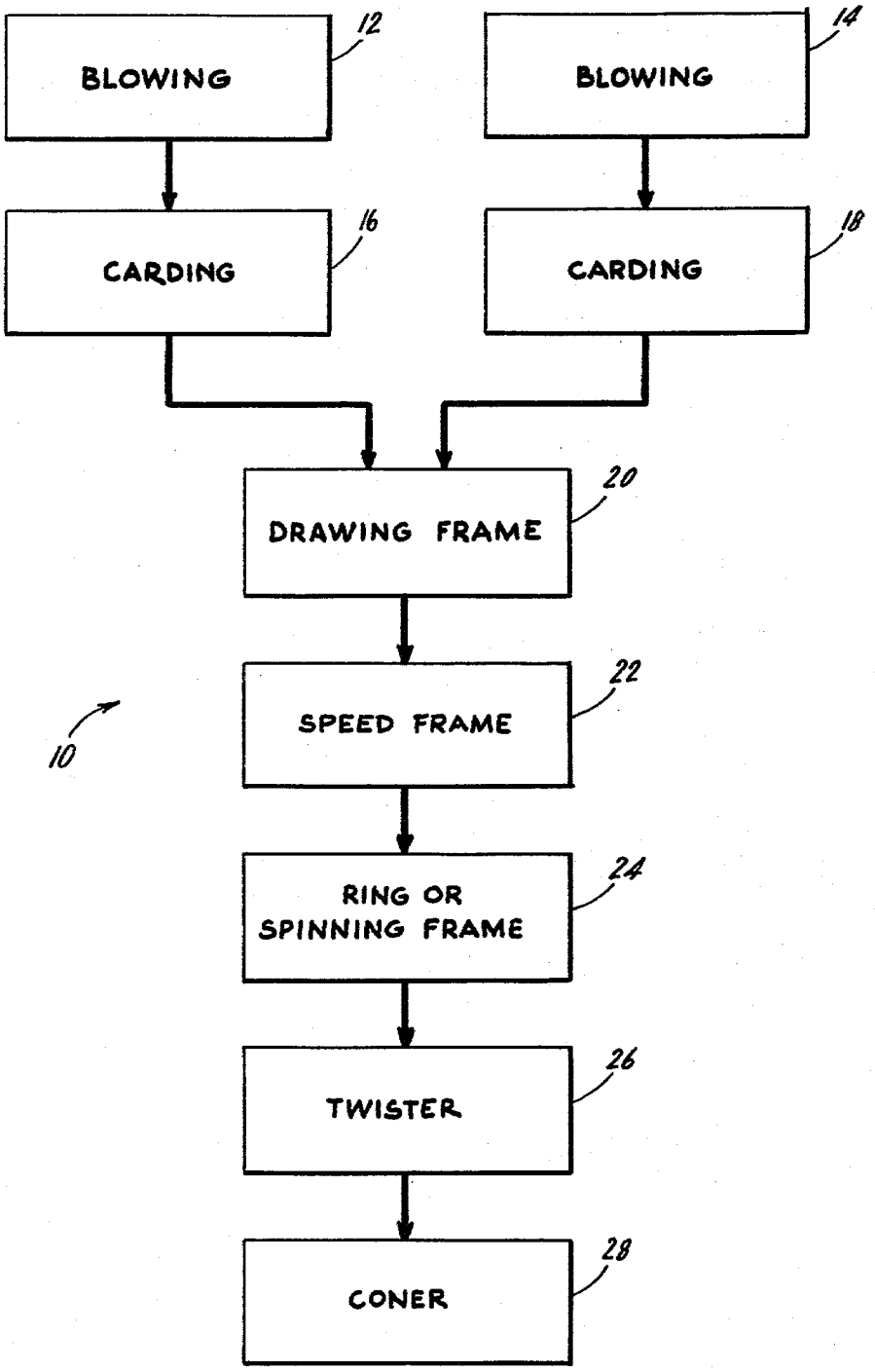
BLOWING
12
BLOWING
14
CARDING
16
CARDING
18
DRAWING FRAME
20
SPEED FRAME
22
10
RING OR
SPINNING FRAME
24
TWISTER
26
CONER
28

FIRE RESISTANT FIBER BLEND

This application is a continuation-in-part of application Ser. No. 853,314, filed Nov. 21, 1977, now abandoned.

The present invention relates generally to fire resistant fiber blends, and more particularly to a blend formed from separately blown and carded slivers of selected matrix and staple fibers.

It has recently become a subject of public concern that various items of wearing apparel, especially children's sleepwear, can be highly flammable and thereby expose an infant or young child to great risk in case of a fire. The problem has become so serious that the Federal Trade Commission some time ago ordered that manufacturers of children's sleepwear treat their products with chemicals which would produce fire resistant qualities in the sleepwear. Such treatment methods have been known and appear, for example, in U.S. Pat. Nos. 3,017,292; 3,749,599; 3,852,947 and 3,864,156. Unfortunately, there has been increasing evidence that such chemically treated sleepwear may have carcinogenic effects on the wearer. Accordingly, a demand was created for fire resistant fabrics, especially for use in children's sleepwear, that are not treated with potentially dangerous chemical substances and yet still meet or exceed current children's Sleepwear Standards including DOC FF 3-71 and DOC FF 5-74.

Specifically, Standard DOC FF 3-71 mandates that for five specimens of a given fabric to be used for children's sleepwear, the average char length shall not exceed 7.0 inches (17.8 cm), that no individual specimen have a char length greater than 10.0 inches (25.4 cm), and that no individual specimen have a residual flame time greater than 10 seconds. As far as is known, all fabrics which claim to pass Standard DOC FF 3-71 exhibit average char lengths of no less than about 4 inches, and all have a residuals flame time of at least several seconds.

It is also highly desirable that the fabric still meet those criteria after at least 50 launderings such as might be expected during the useful life of the finished garment.

Up to now, all known fabrics which are alleged to pass Standards DOC FF 3-71 prior to laundering do not make the same claim after 50 washings. Further, any fumes which might be given off by the fabric as it burns must be nontoxic, thereby precluding fabrics made of, for example, polyvinylchloride fiber blends.

Fibers which alone are inherently fire resistant are known in the art, and are disclosed, for example, in U.S. Pat. Nos. 3,887,676 and 3,925,290. One such fiber (hereinafter referred to as a "matrix fiber") is composed of about 50% Vinal and about 50% Vinyon. However, these fibers are not strong enough to form their own fabrics, tend to have a non-uniform composition, and are not susceptible of being easily dyed. In general, they exhibit an undesirably rough hand or feel when made into fabrics, and are therefore not commercially acceptable. On the other hand, conventional staple fibers such as cotton and polyester, which are suitable for production into comfortable piece goods are not alone fire resistant so as to comply with the current standards for children's sleepwear.

One known solution to the problem of producing a chemically untreated fire resistant fiber blend has been to initially combine inherently fire resistant fibers and staple fibers in specific proportions, the fibers being provided in bales of short slivers normally under two inches in length, and then processing the combined slivers to produce the blended fiber and obtain yarn for the fabric. It has been found, however, that such a procedure tends to provide yarns having non-uniform cross-sectional areas and, therefore, non-uniform fire resistant characteristics; that is, there may be areas of a fabric made from the yarn which are not sufficiently fire resistant to meet government standards.

Specifically, prior attempts to blend the above mentioned matrix fiber with staple fibers have all failed to provide fabrics capable of even meeting Standard DOC FF 3-71. The prior matrix blends were often spun into relatively thin yarns of an English Cotton Count measure ("E.C.C.") of 40/1, in an attempt to yield fabric softness similar to the brushed cotton of which most baby sleepwear had been made. Also, the matrix and staple fibers forming the blends were blown and carded together, as has been the usual practice for other prior chemically untreated fire resistant blends. Moreover, conventional techniques for producing blended staple fibers such as disclosed in U.S. Pat. Nos. 3,067,471 and 3,176,351, and British Pat. No. 1,134,187, have not been successfully employed to produce a fire resistant blend which can meet or exceed the current standards, as far as is known.

It is an object of the present invention to overcome the above and other shortcomings in prior fire resistant fiber blends.

It is another object of the present invention to provide a method for producing a fire resistant fiber blend which can be used to produce fabrics capable of meeting and exceeding current standards for children's sleepwear.

It is yet another object of the present invention to provide a method for producing a fire resistant blended yarn of uniform cross section, knitting and weaving reliability, good dye susceptibility and other desirable characteristics.

In accordance with an illustrative embodiment demonstrating objects and features of the present invention, a method for producing a chemically untreated fire resistant fiber blend from independent sources of matrix and staple fibers provides for independent air blowing of the fire resistant and staple fibers, respectively. The blown fibers are next independently carded to uniformly orient them. Given proportions of each of the carded fibers are then blended together in a drawing step to provide a blended fiber sliver of about 65 to about 85 percent of the matrix fibers and about 15 to about 35 percent of the staple fibers. The blended sliver is then formed into a rope and spun into a yarn while maintaining a substantially uniform cross section in the blended yarn.

The finished yarn can be knitted or woven on conventional machinery. Again, care must be taken to operate at speeds which will not cause reduced cross sections in the yarn and thereby yield potentially flammable segments of fabric produced from the yarn.

The above brief description, as well as further objects, features and advantages of the present invention, will be more fully understood by reference to the following detailed description of a presently preferred, but nonetheless illustrative embodiment in accordance with the invention, with reference being had to the accompanying drawing which represents the process of the present invention.

Referring to the drawing, the present process 10 commences with independent air blowing steps 12 and 14. In step 12, matrix fibers are blown in a conventional hopper type blower such as, for example, a Trutzschler Type 4. A preferred matrix comprises substantially equal parts of Vinal and Vinyon fibers, each about 2 to 2½ inches in length, as may ordinarily be purchased in large bales. In blowing step 12, lint, dirt, flith and other impurities are removed from the matrix fibers. Such impurities, if left combined with the matrix fibers, would adversely affect their fire resistance and render any yarn produced therefrom unfit for use in a fire resistant fabric.

Laps of the blown, disoriented matrix fibers are next carded, as represented by block 16. A conventional carding machine such as, for example, a Crosrol High Speed Type machine can be used. This step brushes the matrix fiber laps so as to produce slivers wherein the fibers are uniformly oriented.

Blowing of the selected staple fibers is done separate and apart from the blowing of the matrix fibers, as represented by block 14. In this step, conventional staple fibers such as, for example, cotton, flax, linen, polyester, nylon and rayon are cleaned and formed into laps which are subsequently carded as indicated by block 18. The blowing step 14 may also be performed in a conventional apparatus such as the Trutzschler Type 4 but, as already stressed, must be performed independently of the blowing of the matrix fibers, according to the present invention. Carding of the laps of staple fibers may be performed by an Ashworth Type AHP-1C carder, for example.

Slivers of matrix and staple fibers, as obtained from the separate carding steps 16 and 18, respectively, are drawn together by a drawing frame as represented by block 20. A conventional drawing frame machine such as, for example, Platt Type 740, can be used to perform this step wherein bulky, blended slivers of matrix and staple fibers are formed. It is important, during drawing step 20, that the desired weight proportions of matrix and staple fibers drawn together be closely maintained. Also, for a polyestermatrix blended fiber according to the present invention, it is preferred that the proportion of polyester not exceed about 35 percent. For a cotton-matrix blend the weight proportion of cotton should not exceed about 15 percent.

The bulky, blended slivers as obtained after drawing step 20, above, are preferably thickened on a speed frame apparatus as indicated by block 22. Such apparatus may be, for example, a Marzoli Type BC-3. The purpose of this step is to form a relatively heavy sliver or rope of blended fibers in preparation for a subsequent spinning step in which the desired blended yarn is formed.

Ropes of the blended fibers obtained from the speed frame step 22 are spun on a ring or spinning frame machine such as, for example, a Platt Type 800. During this step, represented by block 24 in diagram 10, it is important that the spinning rate not exceed 10,000 RPM. It has been discovered that spinning of the ropes at conventional speeds, which range from 16,000 to 20,000 RPM, has deliterious effects on the spun yarn such as would impair its fire resistant properties. In particular, it has been found that spinning within the higher, conventional speed range causes reduced cross sections in the spun yarn. Operating below the conventional range unexpectedly overcomes this problem. A preferred operating range for the spinning step 24 is from about 8,000 to about 10,000 RPM.

Continuing, the spun yarn is then conventionally processed such as by, for example, a twisting machine (block 26) for crimping the yarn to a suitable degree depending upon whether it is to be later knitted or woven, and a coning machine (block 28) which arranges the crimped yarn in the form of conventional cones for ease of use when knitting or weaving therewith.

Should the fire resistant blended yarn produced according to the present invention be later used in producing a knitted fabric, care must again be taken during the knitting step to operate at speeds which will not cause reduced cross sections in the yarn such as might result in potentially flammable areas in the finished fabric. Also, the knitting machine must be kept substantially free from flammable contaminates (e.g. cotton lint) which otherwise might be trapped within the fabric.

Yarn produced from the present fiber blend will be easy to knit or weave, have good tensile strength, will be readily susceptible to dyeing and, most important, will provide uniform fire resistant characteristics in fabrics knitted or woven therefrom.

Without intending to limit the scope of the present invention, the following examples are set forth to demonstrate the unexpected and superior fire resistant characteristics obtained with fabrics knitted from blended yarn in accordance with the present invention. Standard DOC FF 3-71 is incorporated in its entirety by reference herein to support the disclosed data.

EXAMPLE 1

A gold dyed fabric knitted from a blended yarn according to the present invention, of 85 percent matrix and 15 percent cotton fibers, and of an E.C.C. of 38/1 was evaluated before laundering according to DOC FF 3-71 with the following results:

Individual char lengths of five speciments: 1.4 in.; 1.5 in.; 1.4 in.; 1.5 in.; and 1.7 in.
Average char length: 1.5 in.
Residual flame time: NIL

EXAMPLE 2

A blue printed fabric knitted from a blended yarn according to the present invention, of 80 percent matrix and 20 percent polyester fibers, and of an E.C.C. of 38/1 was evaluated before laundering according to DOC FF 3-71 with the following results:

Individual char lengths of five specimens: 3.0 in.; 3.4 in.; 2.6 in.; 2.2 in.; and 2.0 in.
Average char length 2.6 in.
Residual flame time: NIL The fabrics of both the above examples continued to exceed the requirements of DOC FF 3-71 after 50 launderings, their fire resistant characteristics remaining substantially the same as before laundering. Moreover, the burst strength of these fabrics after 50 launderings was about 98 percent of its value before luandering. Such results are far superior in all respects to those obtained with prior fire resistant fabrics under similar test conditions, as discussed above.

It is important, however, that an E.C.C. of no greater than 38/1 be used for the blended yarns of the present invention. Yarns of greater count, i.e., thinner cross section, may not uniformly pass the test criteria of DOC FF 3-71 and may support combustion in some instances.

Although specific examples of the present invention have been disclosed for illustrative purposes, it will be appreciated by one skilled in the art that many additions, substitutions and modifications are possible without departing from the scope and spirit of the invention as defined by the accompanying claims.

What I claim is:

1. A method for producing a chemically untreated fire resistant blended yarn from a source of matrix fibers and a source of staple fibers, said method comprising the steps of blowing the matrix fibers to remove impurities therefrom, blowing the staple fibers in an environment isolated from said matrix fiber blowing step to remove impurities therefrom, carding the blow matrix fibers to uniformly orient same, carding the blown staple fibers in an environment isolated from that of said matrix carding step to uniformly orient same, drawing given proportions of said carded matrix fibers and said carded staple fibers together to produce a blended fiber sliver comprising from about 65 percent to about 85 percent by weight of said matrix fibers and from about 15 percent to about 35 percent by weight of said staple fibers, forming said blended fiber sliver into a rope, and spinning said rope to form a fire resistant blended yarn having an English Cotton Count not exceeding about 38/1, said spinning step being performed at a rate in the range of from about 8,000 to about 10,000 RPM to maintain a uniform cross section in said blended yarn.

2. The fire resistant yarn produced in accordance with the method of claim 1.

3. The fire resistant yarn of claim 2, wherein such blended fiber sliver comprises about 85 percent by weight of said matrix fibers and about 15 percent by weight of cotton fibers, wherein said yarn has an English Cotton Count of about 38/1.

4. The yarn of claim 2, wherein said blended fiber sliver comprises about 80 percent by weight of said matrix fibers and about 20 percent by weight of polyester fibers, wherein said yarn has an English Cotton Count of about 38/1.

5. A knitted matrix-cotton fabric comprising chemically untreated fire resistant blended yarn, said fabric having a char length of from about 1.2 inches to about 2.0 inches and a residual flame time of substantially nil, said yarn being produced from separate sources of matrix fibers and cotton fibers, respectively, said separate sources being independently blown and carded in respective environments isolated from each other and thereafter drawn together to provide a blended fiber sliver comprising about 85 percent by weight of said matrix fibers and about 15 percent by weight of said cotton fibers, said blended fiber sliver then being spun to provide said blended yarn having an English Cotton Count not exceeding about 38/1.

6. A knitted matrix-polyester fabric comprising chemically untreated fire resistant blended yarn, said fabric having a char length of from about 2.0 inches to about 3.5 inches and a residual flame time of substantially nil, said yarn being produced from separate sources of matrix fibers and polyester fibers, respectively, said separate sources being independently blown and carded in respective environments isolated from each other and thereafter drawn together to provide a blended fiber sliver comprising about 80 percent by weight of said matrix fibers and about 20 percent by weight of said polyester fibers, said blended fiber sliver then being spun to provide said blended yarn having an English Cotton Count not exceeding about 38/1.

7. The knitted matrix-cotton fabric of claim 5, said knitted matrix-cotton fabric being constructed to pass Standard DOC FF 3-71 after 50 launderings.

8. The knitted matrix-polyester fabric of claim 6, wherein said knitted matrix-polyester fabric is constructed to pass Standard DOC FF3-71 after 50 launderings.

* * * * *